United States Patent [19]

Luke

[11] Patent Number: 4,718,437

[45] Date of Patent: Jan. 12, 1988

[54] SMOKING ARTICLES

[75] Inventor: John A. Luke, Eastleigh, England

[73] Assignee: British-American Tobacco Company, Ltd., London, England

[21] Appl. No.: 945,723

[22] Filed: Dec. 22, 1986

[30] Foreign Application Priority Data

Dec. 23, 1985 [GB] United Kingdom ..... 8531658

[51] Int. Cl.[4] ..... A24D 3/04

[52] U.S. Cl. ..... 131/336

[58] Field of Search ..... 131/336, 94, 95

[56] References Cited

U.S. PATENT DOCUMENTS 3,410,275 11/1968 Tucker ..... 131/336

3,847,161 11/1974 Morgenstern ..... 131/336

*Primary Examiner*—V. Millin

*Attorney, Agent, or Firm*—Charles G. Lamb

[57] ABSTRACT

A cigarette comprises a tobacco rod and a filter element interattached by an air-impermeable tipping wrapper, the rod and the element abutting each other along a flat, continuous plane inclined at 45° to the longitudinal axis of the cigarette. The tipping wrapper does not reach to the maximum upstream extent of the element, therefore air is able to enter the exposed air-permeable periphery of the element without the need for perforations in the air-impermeable tipping wrapper.

9 Claims, 3 Drawing Figures

1
3
8
12
5
4
II
II
II
II
10
11
7

5
12
13
9
3
1
4
7
6
8
2

5
9
3
1
14
7
15
6
8
2

SMOKING ARTICLES

This invention relates to smoking articles comprising ventilated mouthpieces.

A commonly established practice of the tobacco industry is to provide for the ingress of ventilation air into the filter tips of filter tipped cigarettes by the use of macro or micro perforations in the tipping wrappers, such perforations being made mechanically, electrostatically or by laser beam.

A significant determinant of the degree of ventilation of a filter tipped cigarette which is ventilated by way of tipping perforations is the pressure drop of which the air is subject in the passage thereof through the perforations. The pressure drop value is dependent upon the size of the perforations per unit area. It is a well established practice to produce the perforations during the cigarette manufacturing process and, in order to ensure that the specified ventilation value is consistently attained, the cigarettes are continually tested and the perforating apparatus appropriately adjusted when there is detected a drift away from the specified ventilation value. These test and feedback procedures are complex and should there be a failure of them, even if only of short duration, the result, at the high speed of operation of modern cigarette machinery, may be the production of a large number of faulty cigarettes.

It is an object of the present invention to provide improved means for the ingress of ventilation air into mouthpieces of smoking articles other than by using tipping wrapper perforations.

The present invention provides a smoking article comprising a smoking material rod and a mouthpiece element attached to said rod by a tipping wrapper, first and second circumferentially extending edges of said wrapper being respectively further from and nearer to the mouth end of said article, wherein at the periphery of said article the downstream end face of said rod extends at either side of said first edge of said wrapper, air ingrss means being provided intermediate said face of said rod and said first edge of said wrapper.

Preferably, the downstream end face of the smoking material rod and the upstream end face of the mouthpiece element are in abutment. The mouthpiece element, which may be a plug of filtration material, advantageously abuts the smoking material rod in a flat, continuous plane inclined to the longitudinal axis of the smoking article, the angle of inclination suitably being in the range of 30 to 60 degrees and preferably at or in the region of 45 degrees.

Cigarette filter plugs comprising inclined end faces are disclosed in United Kingdom Patent Specifications Nos. 1,336,465 and 2,132,467A and in U.S. Pat. Nos. 3,547,132, 3,756,250 and 3,847,161.

The air ingress means can comprise an air-flow groove in the article, advantageously in the mouthpiece element, which groove extends beneath the tipping wrapper from the side of the first edge of the tipping wrapper remote the mouth end of the article. The groove may extend to a location spaced from the mouth end of the mouthpiece element and be in air-flow communication with the interior of the mouthpiece element. The groove may open, at the downstream end thereof, into an annular air-distribution groove from which air is able to flow into the interior of the mouthpiece element.

Instead of the air ingress means comprising an air-flow groove, at least a portion of the periphery of the article intermediate the downstream end face of the smoking material rod and the first edge of the tipping wrapper is air permeable.

As used herein, the term 'mouthpiece element' refers to an element incorporated or to be incorporated in a smoking article at the mouth end thereof. Such an element, or a portion thereof, may take the form of a filter.

In order that the present invention may be clearly understood and readily carried into effect, reference will now be made, by way of example, to the accompanying diagrammatic drawings, in which.

Figure 1:
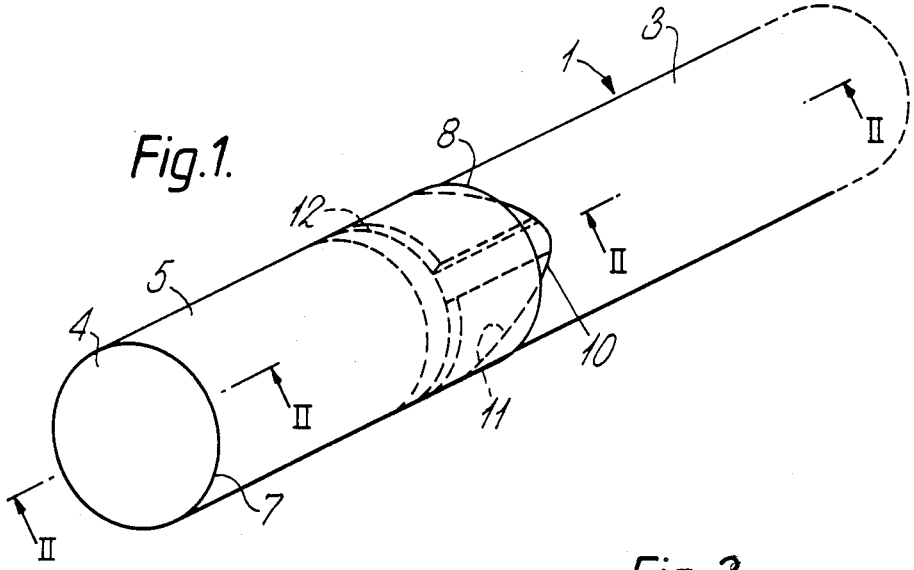
FIG. 1 shows a perspective view of a filter tipped cigarette.
Figure 2:
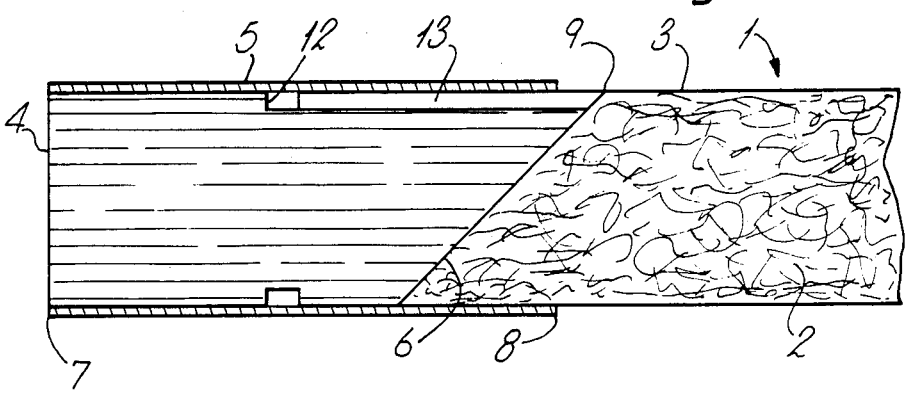
FIG. 2 shows an axial section of the cigarette of FIG. 1 at a plane II—II.

The cigarette shown in FIGS. 1 and 2 comprises a cigarette rod 1, of cut tobacco filler 2 enwrapped in a paper wrapper 3, and a self-sustaining plug 4 of fibrous cellulose acetate filtration material, providing a mouthpiece element, which is attached to the rod 1 by a tipping wrapper 5 of air impermeable paper.

As is best observed from FIG. 2, end face 6 of the plug 4 in abutment with the filler 2 of the rod 1 is inclined, at an angle of 45 degrees, to the longitudinal axis of the cigarette. The tipping wrapper 5 extends from a first circumferentially extending edge 8 thereof remote the mouth end of the plug 4 to a second circumferentially extending edge 7 thereof at the mouth end. The edge 8 is somewhat short of that location, designated by reference numeral 9, on the end face 6 of plug 4 which is furthest from the mouth end of plug 4. This means that a minor length 10 of peripheral boundary line 11 extends at the side of the edge 8 of the tipping wrapper 5 remote the mouth end of the cigarette, the result being that an area of the peripheral surface of the plug 4, bounded by the edge 8 of the wrapper 5 and the length 10 of the boundary line 11, is exposed to view.

As may be seen from FIGS. 1 and 2, the filter plug 4 comprises a circumferentially extending groove 12, the walls of which are air permeable, and a groove 13 which extends from the groove 12 to the end of the plug 4 at the location 9. The groove 13 may have air-permeable or, preferably, air-impermeable walls. Thus when the cigarette is smoked, ventilation air is drawn into the groove 13 at the upstream end thereof, the air passing down the groove 13 to the groove 12, from which latter groove the air enters the interior of the plug 4.

Filter plugs other than the self-sustaining type described above are also suitable for cigarettes in accordance with the invention.

Figure 3:
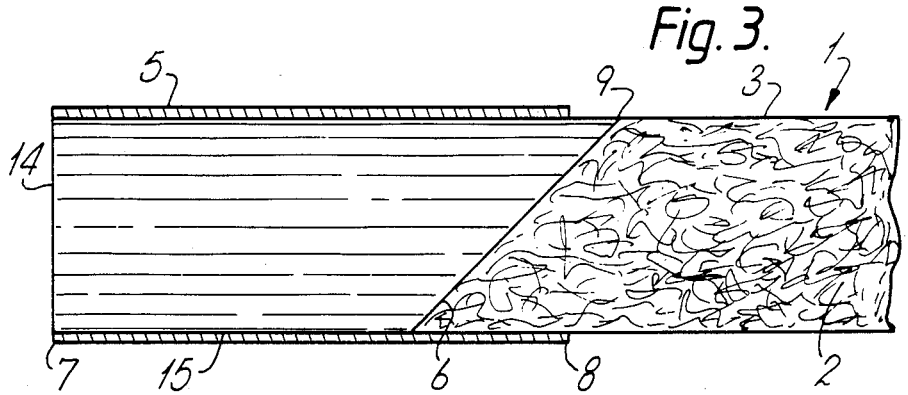
FIG. 3 shows an axial section of a cigarette similar to FIG. 1.

In FIG. 3 similar reference numerals are maintained for like parts. The figure shows a cigarette rod 1, of cut tobacco filter 2 enwrapped in a paper wrapper 3, and a cellulose acetate filter plug 14 wrapped in a porous plugwrap 15, providing a mouthpiece element, which element is attached to the rod 1 by a tipping wrapper 5 of air impermeable paper. The mouthpiece element is ungrooved and ventilation air enters the element directly through the area of the periphery of the element exposed to view between the edge 8 of the tipping wrapper 5 and the location 9 on the end face 6 of the element which is furthest from the mouth end of the cigarette rod 1.

Suitable plugwrap materials in which grooves can be formed are those disclosed in U.K. Patent Specification Nos. 2,134,365A and 2,127,273A. The latter teaches that the plugwrap at the annular groove can be totally removed by a thermal forming process. A suitable groove thermal forming process is disclosed in U.K. Patent Specification No. 1,507,765.

Other configurations of the boundary between the cigarette rod and the filter plug suitable for cigarettes in accordance with the present invention will be apparent to those skilled in the art.

What is claimed is:

1. A smoking article comprising a smoking material element attached to said rod by a tipping wrapper, the rod and the element abutting each other along a plane inclined to the longitudinal axis of the article, said tipping wrapper having first and second circumferentially extending edges, said first edge being at the abutment of the rod and the element, and the second edge being near to the mouth end of said article wherein at the periphery of the abutment a portion of said element extends upstream of and beyond said first edge of said wrapper thereby defining air ingress means into said element upstream of said first edge of said wrapper.

2. A smoking article as claimed in claim 1, wherein said element abuts said rod in a flat, continuous plane inclined to the longitudinal axis of said article.

3. A smoking article as claimed in claim 2, wherein the angle of inclination is in the range of 30 to 60 degrees.

4. A smoking article as claimed in claim 3, wherein said angle of inclination is, or is in the region of, 45 degrees.

5. A smoking article as claimed in claim 1, wherein said element comprises an airflow groove extending beneath said wrapper from the side of the first edge of said wrapper remote the mouth end of said article.

6. A smoking article as claimed in claim 5, wherein said element further comprises an annular groove into which said air-flow groove opens.

7. A smoking article as claimed inclaim 6, wherein the walls of said annular groove are air-permeable.

8. A smoking article as claimed in claim 5, 6 or 7, wherein the walls of said air-flow groove are air-impermeable.

9. A smoking article as claimed in claim 1, wherein said wrapper is air-impermeable.

* * * * *

UNITED STATES PATENT AND TRADEMARK OFFICE

CERTIFICATE OF CORRECTION

PATENT NO. : 4,718,437

DATED : January 12, 1988

INVENTOR(S) : John A. Luke

It is certified that error appears in the above—identified patent and that said Letters Patent is hereby corrected as shown below:

In claim 1, line 18, "near" should be ---nearer---.

Signed and Sealed this

Nineteenth Day of July, 1988

*Attest:*

DONALD J. QUIGG

*Attesting Officer*

*Commissioner of Patents and Trademarks*